US005411320A

United States Patent [19]

Alderman et al.

[11] Patent Number: 5,411,320

[45] Date of Patent: May 2, 1995

[54] WHEELS THAT PROVIDE LATERAL FRICTION ON ICE

[76] Inventors: Richard L. Alderman, 3580 Breckenridge Ct. Apt. 3, Madison, Wis. 53713; Donald C. Hue, 4827 Helgeland Dr., Sun Prairie, Wis. 53590

[21] Appl. No.: 183,862

[22] Filed: Jan. 21, 1994

[51] Int. Cl.[6] ..... B60B 15/00

[52] U.S. Cl. ..... 301/5.3; 280/11.23

[58] Field of Search ..... 301/5.3, 5.7; 280/7.13, 280/11.23, 11.22, 11.19

[56] References Cited

U.S. PATENT DOCUMENTS

| | | | |
|---|---|---|---|
| 1,489,197 | 4/1924 | Daverkosen et al. | 301/5.3 X |
| 2,377,366 | 6/1945 | Paystrup | 280/11.23 |
| 4,043,565 | 8/1977 | Mogannam | 280/7.13 X |
| 5,259,632 | 11/1993 | Mahoney | 301/5.3 X |

FOREIGN PATENT DOCUMENTS

| | | | |
|---|---|---|---|
| 39995 | 7/1887 | Germany | 280/7.13 |
| 1120895 | 7/1965 | United Kingdom | 301/5.3 |

*Primary Examiner*—Russell D. Stormer

[57] ABSTRACT

The "WHEELS THAT PROVIDE LATERAL FRICTION ON ICE" consists of a wheel with a set of grooves around its outer exterior circumference. Said outer exterior circumference may be either flat or angled as viewed from a point perpendicular to the center of the axis of the wheel. The width of the grooves and/or the distance between the grooves may vary dependent upon design criteria such as diameter, width and weight load for the specific application of the wheel. The shaping of the contact surface of the wheel and the sharpening of its edges shall be done in such a manner as to reduce the physical contact with the ice so that the pressure of the wheels forms a deep enough groove or set of grooves in the ice that enable the development of sufficient lateral friction. The outer exterior circumference of the wheel shall be made of a material that is sufficiently harder than the ice so as to maintain the shape of the contact surface and the degree of sharpness of the edges.

6 Claims, 3 Drawing Sheets

Fig. 2
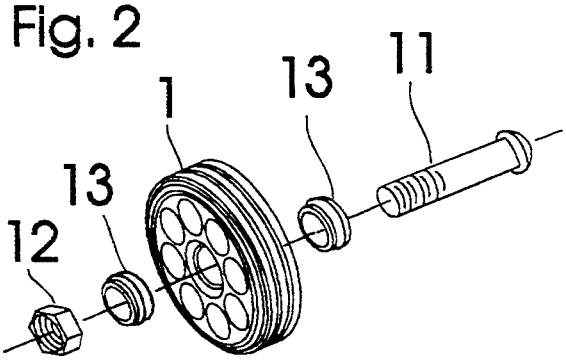
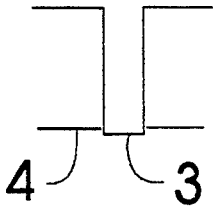
Fig. 3A
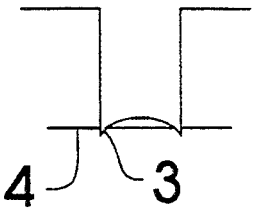
Fig. 3B
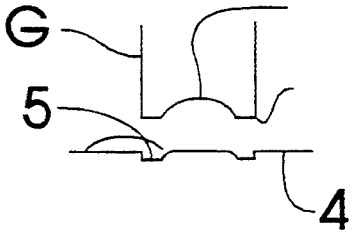
Fig. 4A
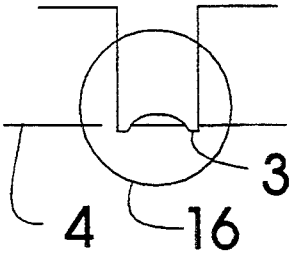
Fig. 3C
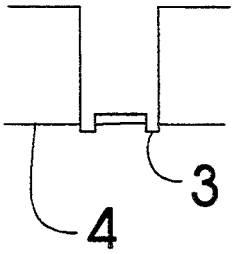
Fig. 3D
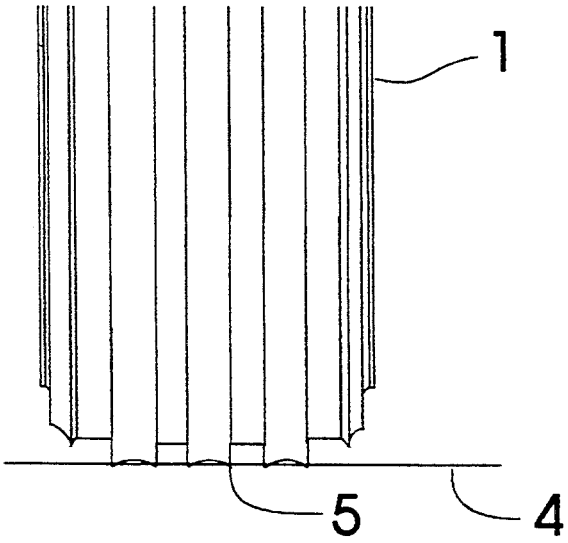
Fig. 4B
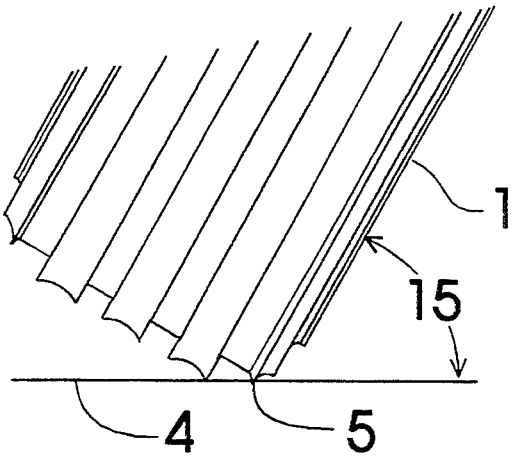
Fig. 4C

WHEELS THAT PROVIDE LATERAL FRICTION ON ICE

FIELD OF THE INVENTION

The present invention relates to a modified wheel for use on ice and particularly, a wheel especially suited for a conversion of figure skates, hockey skates, speed skates, roller skates, in-line skates, bobsleds, ice-boats, or any other use where a conversion to the wheels, as described in this invention, would permit the use of ice, as a surface medium, for locomotion.

BACKGROUND OF THE INVENTION

In the sports of hockey, speed and figure skating there is a long narrow blade attached lengthwise to the bottom of the boots. While this combination works well for most frequent skaters, many would be skaters find it either uncomfortably difficult or even impossible to support themselves on these two narrow blades. Another disadvantage to using blades is the compromise of decreased mobility, when the ice starts to melt. In bobsledding and ice-boating fixed and steerable blades provide the lateral friction needed for locomotion while they are propelled by gravity and wind respectively.

In the sports of roller skating and in-line skating the skater also provides locomotion by pushing off laterally. Using smooth wheels though prohibits the use of these types of skates on the popular skating surface of ice because of the lack of lateral friction. An advantage of the roller skates is the stability of the wide stance of the wheels whereas the typical in-line skates narrow surface contact gives little support.

In U.S. Pat. No. 4,666,169 a boot with a sole plate supports either wheels or an ice skate runner by the use of a two piece truck assembly. U.S. Pat. No. 4,988,122 separate wheel and runner assemblies are mounted to a boot through the use of tabs and slots. Furthermore the boot can be used without either assembly for walking. In U.S. Pat. No. 5,129,663 an ice blade is attached directly to the axle holes. In U.S. Pat. No. 5,193,827 a rotatable cam is used to interchange the ice blade and wheel assembly. All of the boots require a specialized boot. This invention does not require a specialized boot but is a wheel assembly conversion of an existing boot. These skates use a conversion of wheels to a typical ice skating blade in order to change their function from land to ice skating. This does not address either the problem of stability for the ice skater since there is still the need for ice skaters to support themselves on two narrow blades or the compromise of decreased mobility when the ice starts to melt. Other skates as described in U.S. Pat. Nos. 4,618,158 ("improved roller skate"), 3,693,988 ("two wheeled types of roller skates") and 2,533,277 ("increased durability of roller skates") were specifically designed for use on surfaces such as wood, plastic or asphalt. This invention is not disclosed in any one patent or prior art disclosure. Nor does any combination of one or more prior art patents disclose all the features of this invention. U.S. Pat. Nos. 4,699,390 (Cote), 5,048,851 (Alarcon) and 699,904 (White) could not be so combined.

OBJECT OF THE INVENTION

The object of this invention is to provide lateral friction on ice by means of specially designed wheels instead of blades.

Another object of this invention allows the economical dual-use of traditional in-line skates and roller skates on either their current surface use or by using a method that addresses some of the problems associated with previous blade type ice skates that would allow ice as a skating surface. This is accomplished by a simple wheel change to the new wheels, as described in this invention, for use on ice. Then at a time when the skater wishes to skate on a typical surface such as wood, plastic or asphalt they can simply put the original wheels back on. One of the economical benefits of using these wheels is that as children are growing the same wheels as stated in this invention could be used for many years while only having to purchase larger in-line skates or roller skates.

An additional object is option of providing a wider surface contact on ice. This provides more ankle support and eliminates some of the awkwardness of skating thus encouraging more people to skate.

A further object of this invention is by allowing the use of wheels instead of blades or runners, enables the skates to be used on ice in slightly warmer weather due to the rolling action of the wheels.

A still further object is to provide a safer ice skate through the use of wheels which have a tendency to roll over instead of scrape or slice when the skate comes in contact with skin.

SUMMARY OF THE INVENTION

To achieve the above mentioned object, there is provided a wheel for use on ice comprising:

- of a hub portion and an outer circumferential ice-engaging surface;
- of a plurality of circumferential contact surfaces and at least one circumferential relief groove disposed between said contact surfaces;
- of said circumferential contact surfaces being configured to reduce the area of contact with the ice and to form a deep enough groove in the ice surface to develop lateral friction between the ice surface and the wheel;
- of said wheel being made of a material that is sufficiently harder than ice;
- of said circumferential contact surfaces being arranged on said outer circumferential ice-engaging surface of the wheel that at least two of said contact surfaces are in contact with the ice surface when said wheel is perpendicular to the ice and also when said wheel is angled between perpendicular and a predetermined angle from perpendicular to the ice;
- of an aperture through the axis of the wheel to accommodate an axle, and a counterbore on each side of said hub portion to accommodate bearing means;
- of said circumferential contact surfaces that have a smaller diameter at their axial midpoint than at their axial peripheral edges to reduce the area of contact with the ice surface;

When this wheel is used in conjunction with in-line skates an alternative to separate land and ice skates is achieved. Not only is this combination economical but it creates a safer and very unique way to ice skate. An added bonus is that for infrequent skaters or those with ankle problems an effective and attractive way to offer more support will encourage many would be ice skaters.

BRIEF DESCRIPTION OF THE DRAWINGS

FIG. 2 shows an exploded isometric view of the new wheel with two bearings, a selflocking nut and an axle for use on an in-line skate.

FIG. 3A is an enlarged view showing a square shaped contact surface of the new wheel partially embedded in the ice to show a simulation of the grooves caused by the wheels.

FIG. 3B is an enlarged view showing a sharp grooved shaped contact surface of the new wheel partially embedded in the ice to show a similation of the grooves caused by the wheels.

FIG. 3C is an enlarged view showing a grooved shaped contact surfaces of the new wheel partially embedded in the ice to show a similation of the grooves caused by the wheels.

FIG. 3D is an enlarged view showing a square grooved shaped contact surfaces of the new wheel partially embedded in the ice to show a similation of the grooves caused by the wheels.

FIG. 4A is an enlarged view of a portion of FIG. 4 with the contact surface separated from the ice surface.

FIG. 4B is an enlarged view showing the flat portion of the contact surface of the new wheel in contact with the ice.

FIG. 4C is an enlarged view showing the angled portioned of the contact surface of the new wheel in contact with the ice.

DETAILED DESCRIPTION OF THE INVENTION

Figure 1:
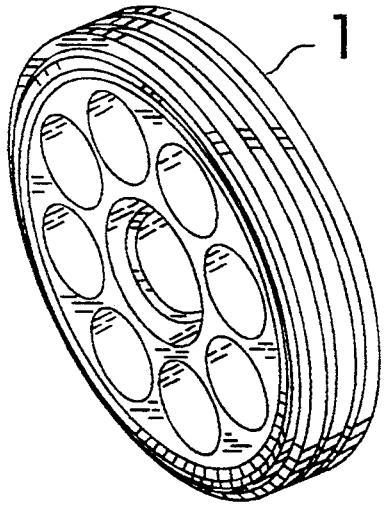
FIG. 1 is an isometric view of a new wheel, designed for use with an in-line skate boot with a flat and angled outer exterior circumference.
Figure 1A:
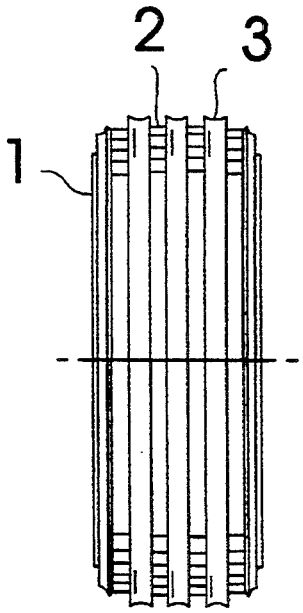
FIG. 1A is a view of the wheel in FIG. 1 as viewed from a point perpendicular to the center of the axis.
Figure 1B:
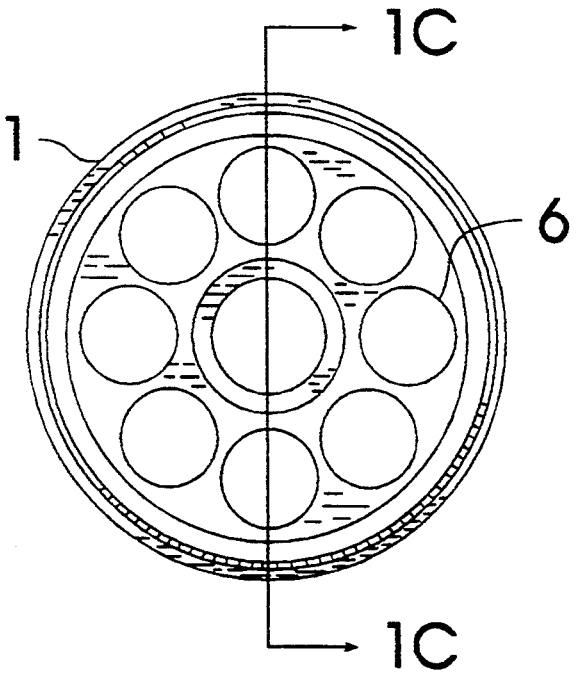
FIG. 1B is a side view of the wheel in FIG. 1.
Figure 1C:
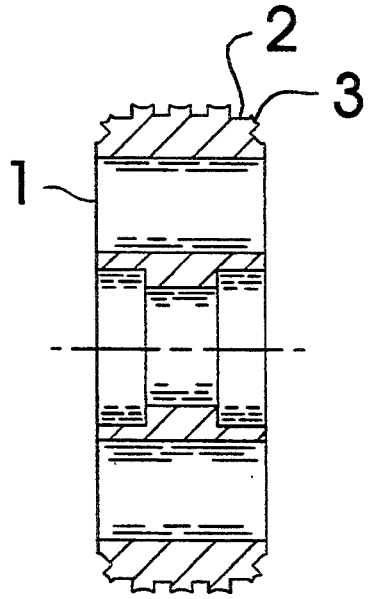
FIG. 1C is a sectional view as designated "section 1C" in FIG. 1B through the center of that wheel.

FIG. 1 shows one possible configuration of the new wheel (l) with the relief grooves (2), FIG. 1A and FIG. 1C, perpendicular to the axis around the outer exterior circumference. The ice-engaging surface (3) of the wheel (1) should be shaped in such a manner, see FIG. 3A, FIG. 3B, FIG. 3C and FIG. 3D for examples, as to reduce the area of contact with the ice (4) so that the pressure forms a deep enough groove (5), FIG. 4A or set of grooves in the ice that along with the sharpened edges enables the development of sufficient lateral friction. FIG. 4A shows an exploded view (16) of FIG. 3C with the contact surface (3), sharpened as in FIG. 3C, suspended above the ice (4) so as to show the groove (5) developed by the wheel (1). FIG. 4A also shows a circumferential contact surface that has a smaller diameter at the axial midpoint (17) than at the axial peripheral edges (18) to reduce the area of contact with the ice surface, also as shown in FIG. 3B, FIG. 3C and FIG. 3D. FIG. 4B shows multiple edges of the wheel (1) making grooves (5) in the ice (4) while the wheel is perpendicular to the ice (4). FIG. 4C shows two edges of the wheel (1) making grooves (5) in the ice (4) while the wheel is at a contact angle (15) of about 65 to 75 degrees to the ice (4). This extra edge in contact with the ice (4) provides the additional lateral friction needed while the skater is pushing off or executing sharp turns. By tilting the skates slightly more to the point that only one edge is in contact with the ice and there is less downward pressure the skater can stop by sliding sideways in the same manner as a hockey skater.

The wheel (1) may have reliefs (6), FIG. 1B, that can serve functions such as weight reduction or esthetic appeal.

Figure 5:
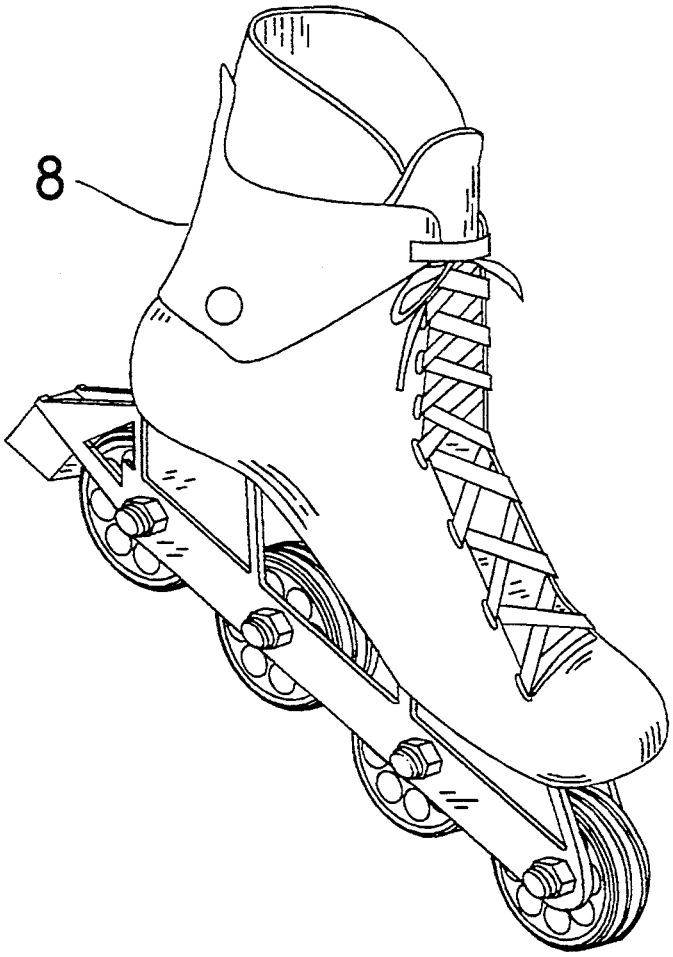
FIG. 5 shows a isometric view of an in-line skate equipped with the new wheels.
Figure 6:
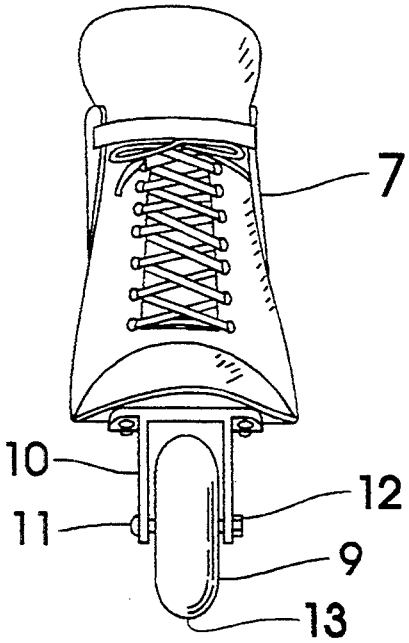
FIG. 6 shows a frontal view of a typical in-line skate.
Figure 7:
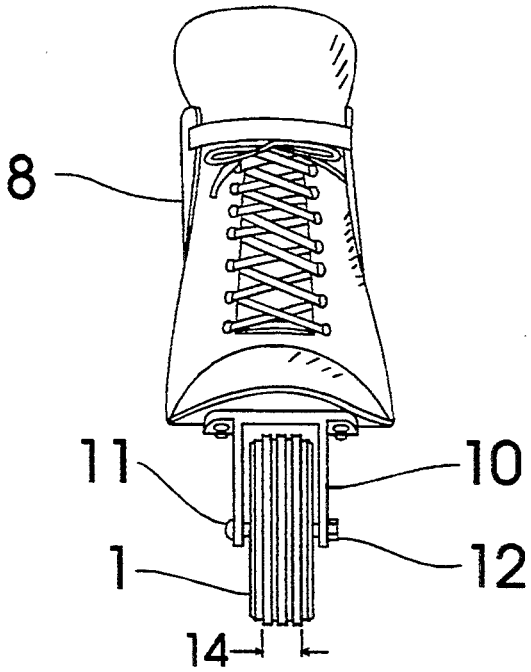
FIG. 7 shows a frontal view of an in-line skate equipped with the new wheels.

The in-line skate (7), FIG. 6, is converted to an in-line roller ice skate (8), FIG. 5, by a simple change from the old wheel (9) to the new wheel (1) as described in this invention. The same axle support bracket (10) is used and to keep the cost of the conversion down the same axles (11), locknuts (12) and bearings (13) can also be used for both wheels (1) (9). The width (14) of the contact surface (3) as shown in FIG. 4B can be designed to be as wide as the wheel (1) for more ankle support.

What is claimed is:

1. A wheel for a roller skate for use on a surface of ice comprising:

a hub portion and an outer circumferential ice-engaging surface;

said circumferential ice-engaging surface comprising a plurality of circumferential contact means and at least one circumferential relief groove disposed between said contact surfaces;

said circumferential contact means being configured to reduce the area of contact with the ice and to form a groove in the ice surface deep enough to develop lateral friction between the ice surface and the wheel;

said wheel being made of a material that is substantially harder than ice;

said circumferential contact means being arranged on said outer circumferential ice-engaging surface of the wheel such that at least two of said contact means are in contact with the ice surface when said wheel is perpendicular to the ice and also when said wheel is at a predetermined angle from the perpendicular to the ice.

2. The wheel of claim 1, wherein said hub portion further comprises an aperture through the axis of the wheel to accommodate an axle, and a counterbore on each side of said hub portion to accommodate bearing means.

3. The wheel of claim of claim 1, wherein said circumferential contact means are raised from the circumferential ice-engaging surface and have a smaller diameter at their axial midpoint than at their axial peripheral edges to reduce the area of contact with the ice surface.

4. The wheel of claim 1, wherein said bearing accommodating bores permit said wheel to be mounted on an in-line skate.

5. The wheel of claim 1, wherein the wheel is interchangeable with a standard in-line skate wheel.

6. A wheel for use in a roller skate on a surface of ice comprising:

a cylindrical ice-engaging surface having a plurality of circumferential contact means;

said circumferential contact means being configured to form at least one groove in the ice surface deep enough to develop lateral friction between the ice surface and the wheel;

said circumferential contact means including first circumferential contact means which are disposed on said cylindrical ice-engaging surface in axial alignment such that at least two of said contact means are in contact with the ice surface when the wheel is perpendicular to the ice surface;

said wheel further including second circumferential contact means at each axial side of said cylindrical ice-engaging surface which have an outer diameter that is less than the outer diameter of said first contact means, wherein one of said first circumferential contact means and the adjacent one of said second circumferential contact means will engage the ice surface when said wheel is oriented at a predetermined angle from the perpendicular to the ice surface.

* * * * *